US007985937B2

(12) United States Patent
Wu et al.

(10) Patent No.: US 7,985,937 B2
(45) Date of Patent: Jul. 26, 2011

(54) DIMMER SWITCH

(75) Inventors: Yun Wu, Oakdale Gardens, NY (US); Alfred J. Lombardi, Syosset, NY (US); Cheng-Lung Chou, Great Neck, NY (US); Azer Ilkhanov, Brooklyn, NY (US)

(73) Assignee: Leviton Manufacturing Co., Ltd., Melville, NY (US)

( * ) Notice: Subject to any disclaimer, the term of this patent is extended or adjusted under 35 U.S.C. 154(b) by 417 days.

(21) Appl. No.: 12/169,233

(22) Filed: Jul. 8, 2008

(65) Prior Publication Data

US 2009/0189542 A1 Jul. 30, 2009

Related U.S. Application Data

(60) Provisional application No. 60/961,188, filed on Jul. 18, 2007.

(51) Int. Cl.
*H01H 9/00* (2006.01)

(52) U.S. Cl. ..... 200/330; 200/331; 200/18; 200/339; 200/310; 200/313

(58) Field of Classification Search ..... 200/329–331, 200/339, 310–316, 18; 174/66, 67; 307/125; 315/292, 294, 297, 320, 129, 133
See application file for complete search history.

(56) References Cited

U.S. PATENT DOCUMENTS 4,489,297 A 12/1984 Haydon et al.
4,654,626 A 3/1987 Carsello
4,669,804 A 6/1987 Munroe
4,835,343 A 5/1989 Graef et al.
4,924,151 A 5/1990 D'Aleo et al.
5,038,081 A 8/1991 Maiale, Jr. et al.
5,059,871 A 10/1991 Pearlman et al.
5,101,141 A 3/1992 Warner et al.
D331,743 S 12/1992 Fujiyoshi
5,191,265 A 3/1993 D'Aleo et al.
5,207,317 A 5/1993 Bryde et al.
5,225,765 A 7/1993 Callahan et al.
5,248,919 A 9/1993 Hanna et al.
(Continued)

OTHER PUBLICATIONS

U.S. Appl. No. 11/559,646, filed Nov. 14, 2006 entited, "RF Antenna Integrated Into a Control Device Installed Into a Wall Switch Box".

(Continued)

*Primary Examiner* — Michael A Friedhofer
(74) *Attorney, Agent, or Firm* — Carter, DeLuca, Farrell & Schmidt, LLP

(57) ABSTRACT

A switching device includes a paddle actuator biased to a rest position and configured to pivot relative to a housing to a depressed position to engage an air-gap switch disposed within the housing. The air-gap switch is configured to change a first state of a load connected to the switching device upon engagement by the paddle actuator. The paddle actuator is defined by a pair of opposing long sides and a pair of opposing short sides and has at least one slot defined therein parallel to the pair of opposing short sides thereof and centrally disposed between the pair of opposing long sides thereof. A rocker actuator is disposed in the at least one slot defined in the paddle actuator and is configured to pivot relative thereto to engage at least one switch. The at least one switch is configured to change a second state of the load connected to the switching device upon engagement by the rocker actuator.

19 Claims, 11 Drawing Sheets

U.S. PATENT DOCUMENTS 5,290,983 A 3/1994 Roberts et al.
5,319,283 A 6/1994 Elwell
5,319,301 A 6/1994 Callahan et al.
5,359,231 A 10/1994 Flowers et al.
D353,798 S 12/1994 Bryde et al.
5,399,940 A 3/1995 Hanna et al.
D356,999 S 4/1995 Alcocer
5,430,356 A 7/1995 Ference et al.
D364,141 S 11/1995 Hanna et al.
5,510,679 A 4/1996 Maiale, Jr. et al.
5,530,322 A 6/1996 Ference et al.
5,637,930 A 6/1997 Rowen et al.
5,662,213 A 9/1997 Kattler et al.
D391,924 S 3/1998 Mayo et al.
5,798,581 A 8/1998 Keagy et al.
5,895,888 A 4/1999 Arenas et al.
5,909,087 A 6/1999 Bryde et al.
5,934,453 A * 8/1999 Sugawara et al. ..... 200/339
5,950,812 A 9/1999 Tanacan et al.
6,005,308 A * 12/1999 Bryde et al. ..... 307/157
6,046,550 A 4/2000 Ference et al.
6,091,205 A 7/2000 Newman, Jr. et al.
6,169,377 B1 * 1/2001 Bryde et al. ..... 315/294
6,178,681 B1 1/2001 Caloia et al.
D439,220 S 3/2001 Mayo et al.
6,211,626 B1 4/2001 Lys et al.
6,297,724 B1 10/2001 Bryans et al.
6,340,868 B1 1/2002 Lys et al.
6,347,028 B1 2/2002 Hausman, Jr. et al.
6,369,524 B1 4/2002 Sid
6,380,692 B1 4/2002 Newman, Jr. et al.
6,421,941 B1 7/2002 Flnke et al.
6,459,919 B1 10/2002 Lys et al.
6,469,457 B2 10/2002 Callahan
6,507,158 B1 1/2003 Wang
6,528,957 B1 3/2003 Luchaco
6,734,381 B2 * 5/2004 Mayo et al. ..... 200/329
6,744,582 B2 6/2004 Shimoda et al.
6,761,470 B2 7/2004 Sid
D498,213 S 11/2004 Savicki et al.
6,815,625 B1 11/2004 Leopold et al.
6,891,117 B1 5/2005 Gouhl et al.
6,917,167 B2 7/2005 Courtney et al.
D517,999 S 3/2006 Merritt et al.
D518,000 S 3/2006 Merritt et al.
D518,446 S 4/2006 Hedderich et al.
D519,466 S 4/2006 Merritt et al.
7,038,910 B1 5/2006 Hodge et al.
D523,824 S 6/2006 Lombardi et al.
7,071,634 B2 7/2006 Johnson et al.
D526,624 S 8/2006 Merritt et al.
D534,873 S 1/2007 Merritt et al.
D534,875 S 1/2007 Wu
D535,627 S 1/2007 Merritt et al.
7,164,238 B2 1/2007 Kazanov et al.
7,166,970 B2 1/2007 Johnson et al.
7,170,018 B2 1/2007 Ilkhanov
D542,230 S 5/2007 Merritt et al.
D543,159 S 5/2007 Merritt et al.
7,247,793 B2 7/2007 Hinkson et al.
7,265,308 B2 9/2007 Endres et al.
D553,102 S 10/2007 Merritt et al.
7,285,723 B2 10/2007 Lindenstraus et al.
7,312,695 B2 * 12/2007 Lehmer et al. ..... 340/426.15
7,335,845 B2 2/2008 Johnsen et al.
D563,326 S 3/2008 Patel et al.
D563,904 S 3/2008 Patel et al.
7,365,282 B2 * 4/2008 Altonen et al. ..... 200/331
D588,035 S 3/2009 Schmalz et al.
7,667,155 B1 2/2010 Ni et al.
7,700,888 B2 * 4/2010 Kurek et al. ..... 200/339
7,728,240 B2 * 6/2010 Dodal et al. ..... 200/252
7,777,145 B2 * 8/2010 Burrell et al. ..... 200/330
2003/0076281 A1 4/2003 Morgan et al.
2003/0226682 A1 12/2003 Tufano et al.
2003/0226684 A1 12/2003 Schmieta et al.
2004/0002792 A1 1/2004 Hoffknecht
2004/0207342 A1 10/2004 Novikov
2004/0212324 A1 10/2004 Callahan
2005/0125083 A1 6/2005 Kiko
2005/0248300 A1 11/2005 Walko et al.
2006/0108208 A1 * 5/2006 Ilkhanov ..... 200/18
2006/0125649 A1 6/2006 Ostrovsky et al.
2006/0279236 A1 12/2006 Johnson et al.
2007/0126366 A1 6/2007 Frid
2007/0193863 A1 8/2007 Wu
2009/0159415 A1 6/2009 Burrell et al.

OTHER PUBLICATIONS

U.S. Appl. No. 11/694,917, filed Mar. 30, 2007 entitled, "Electrical Control Device".

* cited by examiner

DIMMER SWITCH

CROSS REFERENCE TO RELATED APPLICATIONS

This application claims priority to Provisional patent application entitled "DIMMER SWITCH" filed in the United States Patent and Trademark Office on Jul. 18, 2007 and assigned Ser. No. 60/961,188, and relates to U.S. Pat. Nos. D534,875, D517,999, D518,000, D519,466, D526,624, D542,230, D543,159, D535,627, D534,873, 7,170,018, and U.S. Patent Publication No. 2006/0125649, the entire contents of all of which being incorporated by reference herein.

BACKGROUND

1. Technical Field

The present invention relates to a switching device used to control electrical systems and/or devices and, more particularly, relates to a switch for selectively adjusting or varying a state of a current load.

2. Description of Related Art

Switches and controls for electrical systems and devices have been developed that control more than one state of an electrical load or device. While it is now commonplace for devices to control a plurality of states, such as the ON/OFF/DIM/BRIGHT state of a lighting load, the integration of multiple control features in a single device typically requires more complicated manufacturing processes to accommodate the different features.

The present disclosure relates to an integrated control device that is simple to manufacture and less expensive to produce.

SUMMARY

In an embodiment of the present disclosure, a switching device includes a paddle actuator biased to a rest position and configured to pivot relative to a housing to a depressed position to engage an air-gap switch disposed within the housing. The air-gap switch is configured to change a first state of a load connected to the switching device upon engagement by the paddle actuator. The paddle actuator is defined by a pair of opposing long sides and a pair of opposing short sides and has at least one slot defined therein parallel to the pair of opposing short sides thereof and centrally disposed between the pair of opposing long sides thereof. A rocker actuator is disposed in the at least one slot and is configured to pivot relative thereto to engage at least one switch. The at least one switch is configured to change a second state of the load connected to the switching device upon engagement by the rocker actuator.

According to another embodiment of the present disclosure, a switching device includes a paddle actuator biased to a rest position and configured to pivot relative to a housing to a depressed position to engage an air-gap switch disposed within the housing. The air-gap switch is configured to change a first state of a load connected to the switching device upon engagement by the paddle actuator. The paddle actuator is defined by a pair of opposing long sides and a pair of opposing short sides and has at least one slot defined therein parallel to the pair of opposing short sides thereof and centrally disposed between the pair of opposing long sides thereof. A rocker actuator is disposed in the at least one slot and is configured to pivot relative thereto to engage at least one switch. The at least one switch is configured to change a second state of the load connected to the switching device upon engagement by the rocker actuator. A light pipe is operably coupled to the rocker actuator and has a plurality of LEDs disposed thereon configured to indicate at least one of the first state and the second state of the load connected to the switching device upon the actuation of at least one of the paddle actuator and the rocker actuator.

BRIEF DESCRIPTION OF THE DRAWINGS

Various embodiments of the presently disclosed switching device are described herein with reference to the drawings wherein.

DETAILED DESCRIPTION

Figure 1:
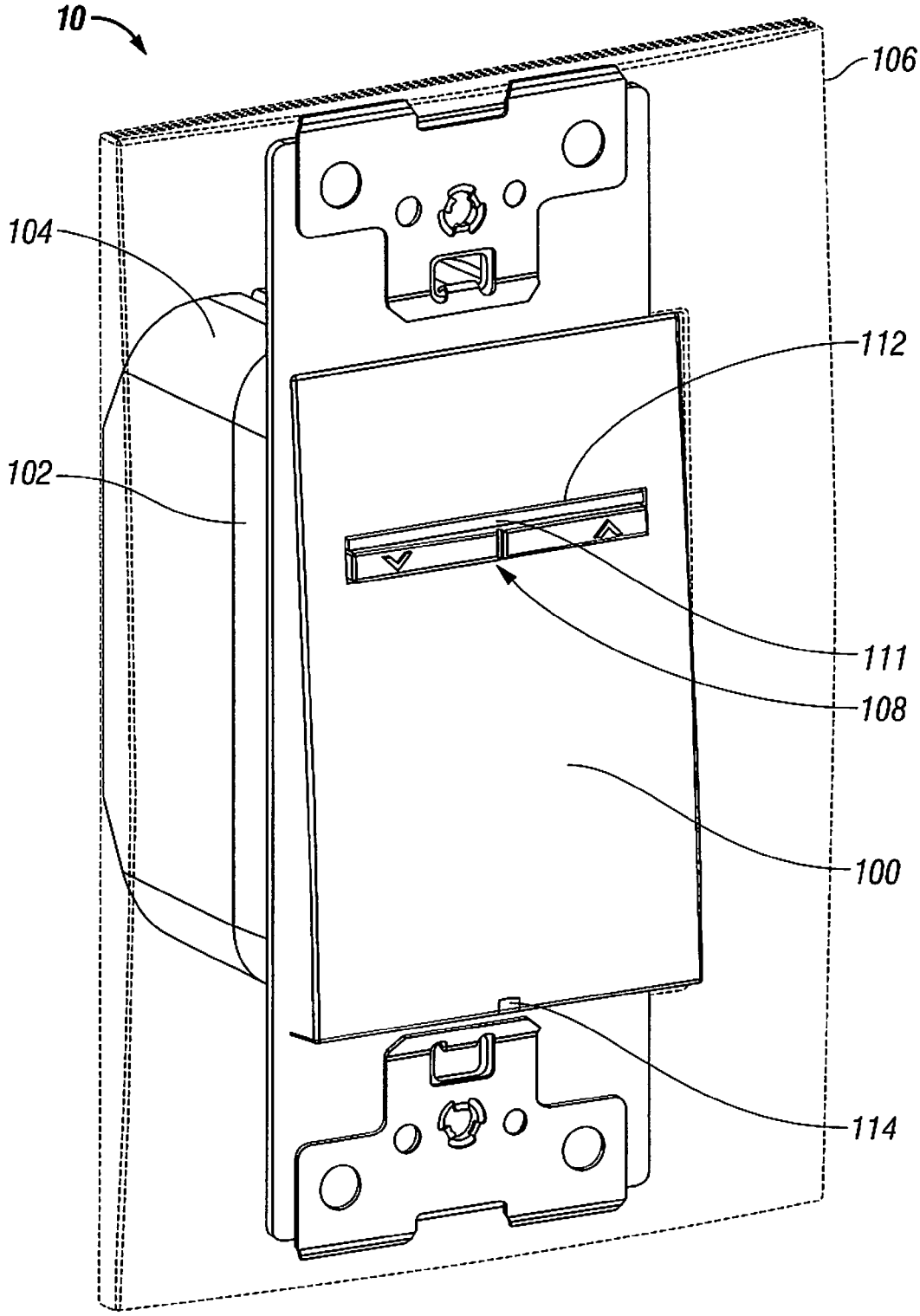
FIG. 1 is a perspective view of a switching device in accordance with the present disclosure having paddle actuator which incorporates a rocker-like intensity control disposed therein.

Particular embodiments of the present disclosure are described hereinbelow with reference to the accompanying drawings wherein like reference numerals identify similar or identical elements. In the following description, well-known functions or constructions are not described in detail to avoid obscuring the present disclosure in unnecessary detail.

The switching device described herein in accordance with the present disclosure relates to a dimmer-like switch characterized by a large paddle actuator having an intensity actuator embedded therein. The paddle actuator is substantially rectangular in shape having a pair of opposing long sides and top and bottom short sides. The paddle actuator is biased to a rest position by a one or more springs (e.g., leaf springs) formed in a sub-panel below the paddle. A user may press the paddle to overcome the bias and cause the paddle to rotate about one or more pivots to a depressed position wherein an ON/OFF switch is actuated. When released, the paddle returns to a biased rest position. Thus, the ON/OFF switch is actuated only momentarily. In this way, the paddle has a depressed position and a rest position rather than alternating between an "ON" position and an "OFF" position common to most household switches.

As mentioned above, an intensity actuator is disposed on a surface of the paddle actuator and is configured to rock about one or more additional pivots. The intensity actuator is biased to a rest position by one or more springs formed in the subpanel. Springs are configured to bias the intensity actuator in a neutral, generally central position. A user may press the intensity actuator to overcome the bias of either leaf spring to adjust (decrease or increase) intensity as desired. More specifically, this action may be configured to change the state of a load connected to the switching device from DIM to BRIGHT and/or any one or more levels therebetween (e.g., greater than DIM and less than BRIGHT). When the intensity actuator is released, it returns to the neutral position.

The intensity actuator is located within an opening defined in the paddle actuator and is configured to operate independently of the paddle actuator. In embodiments, the opening is defined horizontally relative to the paddle actuator. That is, the opening is defined parallel to the top and bottom short sides of the paddle actuator. Further, opening may be defined close to the top short side of the paddle actuator or, alternatively, close to the bottom short side of the paddle actuator.

Figure 2:
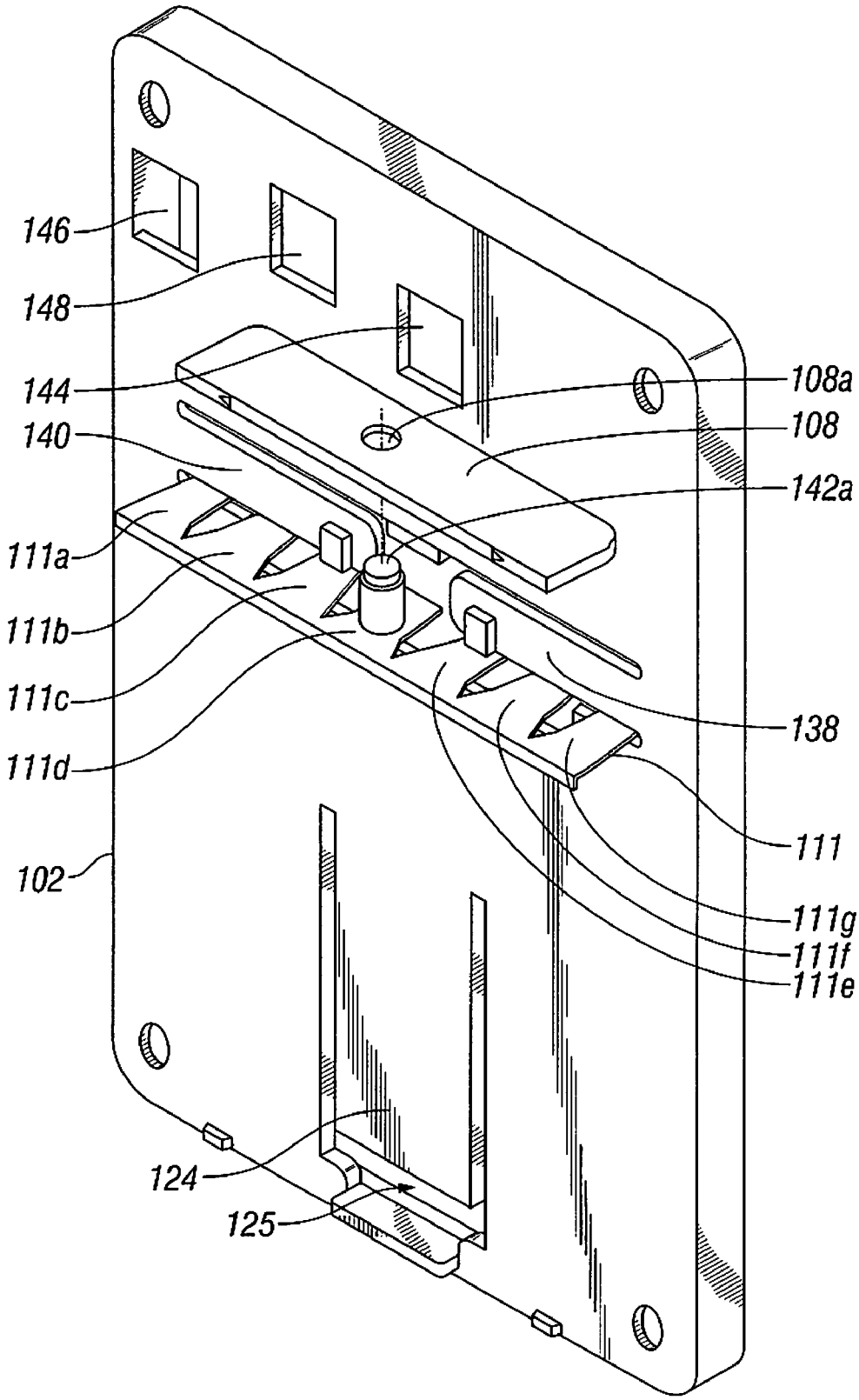
FIG. 2 is a perspective view of a housing for mechanically supporting the paddle actuator of FIG. 1.
Figure 4:
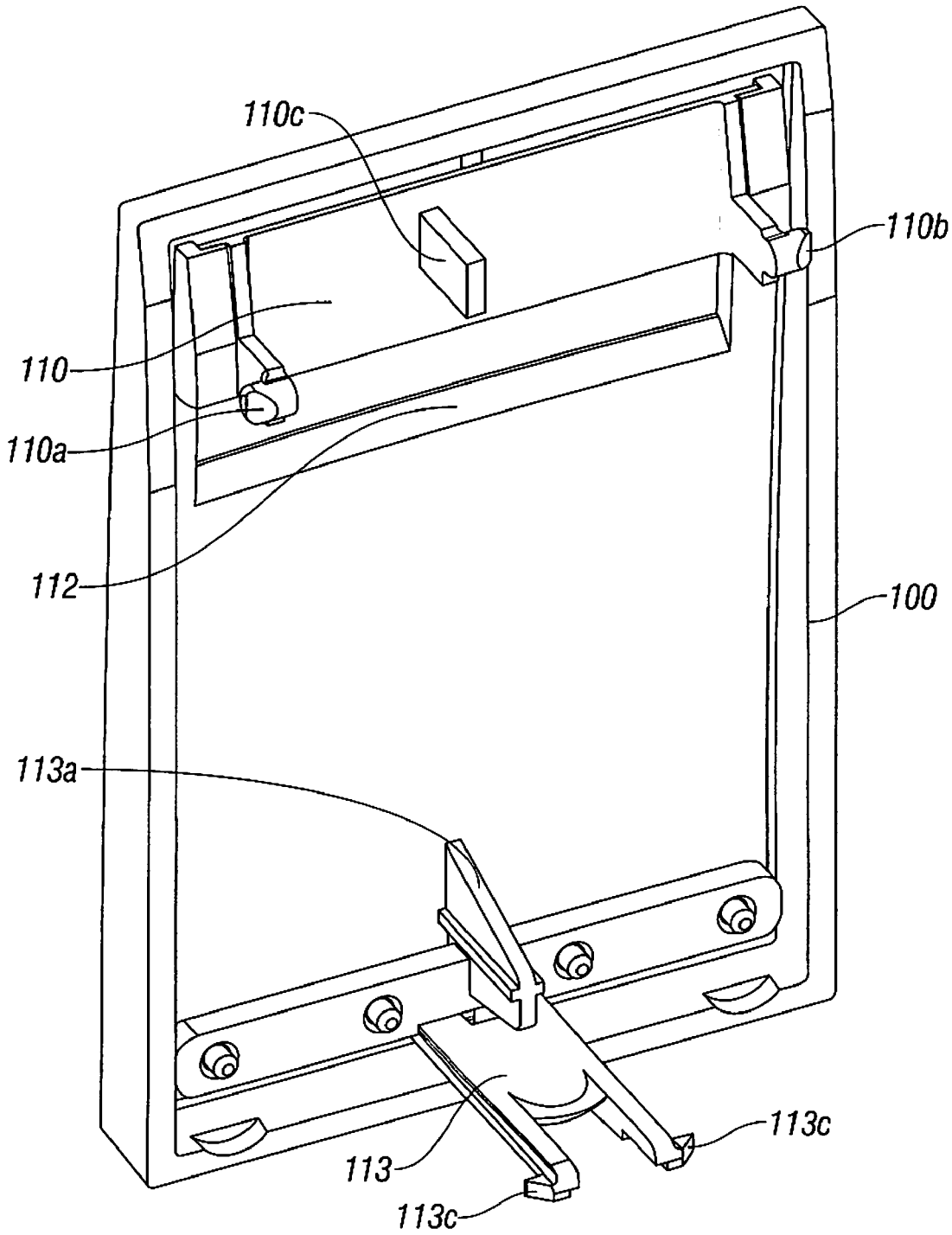
FIG. 4 is a perspective view of an actuator of the actuating assembly of FIG. 3.

Referring now to FIGS. 1, 2, and 4, depicted therein is a switching device generally identified as reference numeral 10 which includes a housing 104, a housing cover 102, and a paddle actuator 100. The paddle actuator 100 includes an opening 112 defined therethrough which is dimensioned to receive a light pipe 111 and a rocker switch 108 therein. The paddles actuator 100 includes a series of mechanical interfaces 110A, 110B and 110C which matingly engage a corresponding number of mechanical interfaces (slots 144, 146 and 148) to maintain the paddle actuator 100 in pivotable relationship with the housing 104. A paddle actuating tab 113 (described in more detail below) includes locking elements 113C which mechanically interface with a corresponding slot 125 defined within the housing cover 102. The paddle actuator may optionally also include a light 114 (light emitting diode ("LED")) embodied therein and configured to provide a visual status of the switching device. Alternatively, more than one light 114 can be provided which turn on and off sequentially upon pressing rocker switch 108. The paddle actuator 100 is configured to be installed in conjunction with a faceplate 106 adapted to mechanically engage the housing 104 which, in turn, is installable within a standard electrical switch box.

Figure 3:
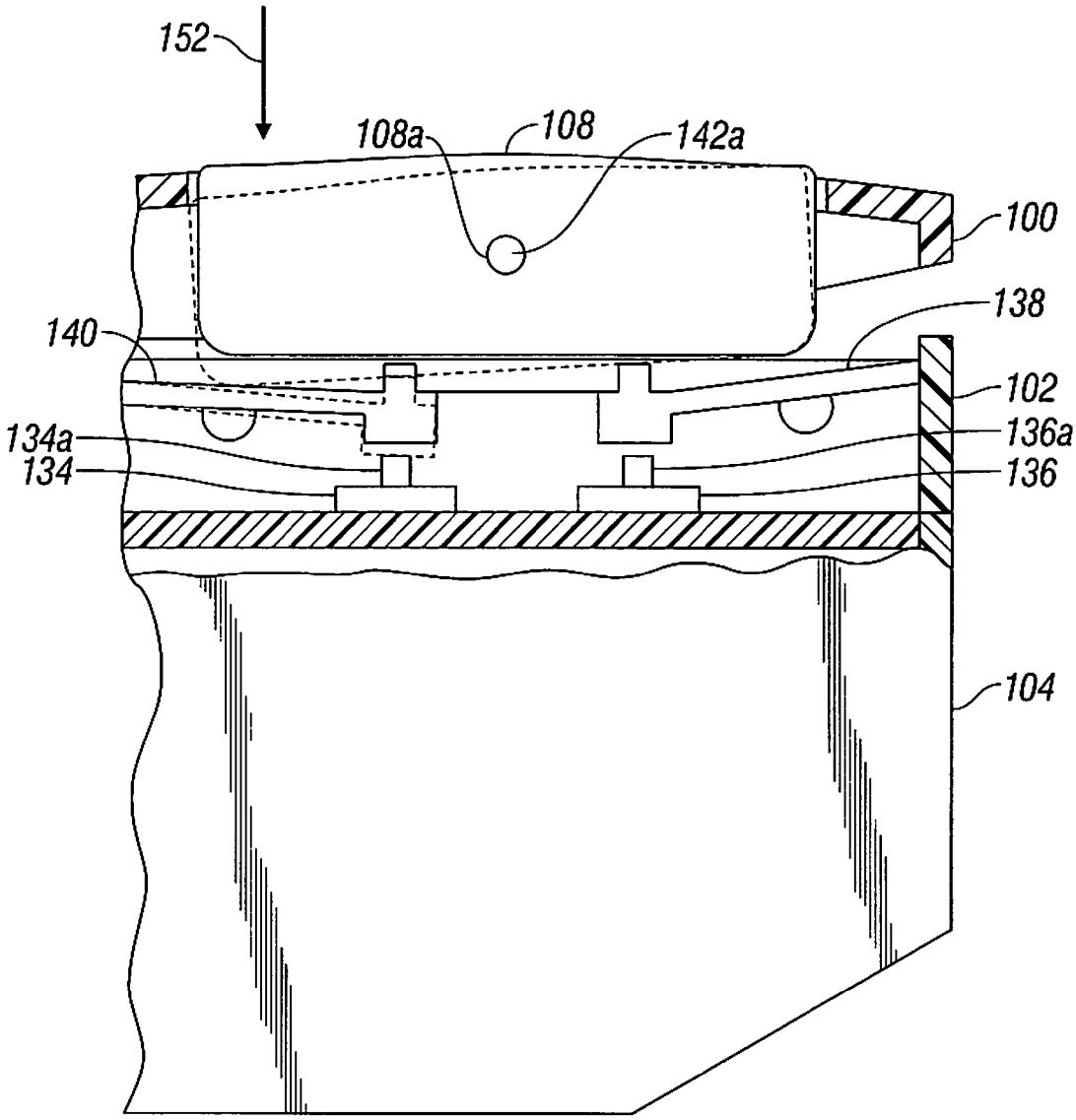
FIG. 3 is a partial cross sectional view of an actuating assembly operatively associated with the switching device of FIG. 1.
Figure 5:
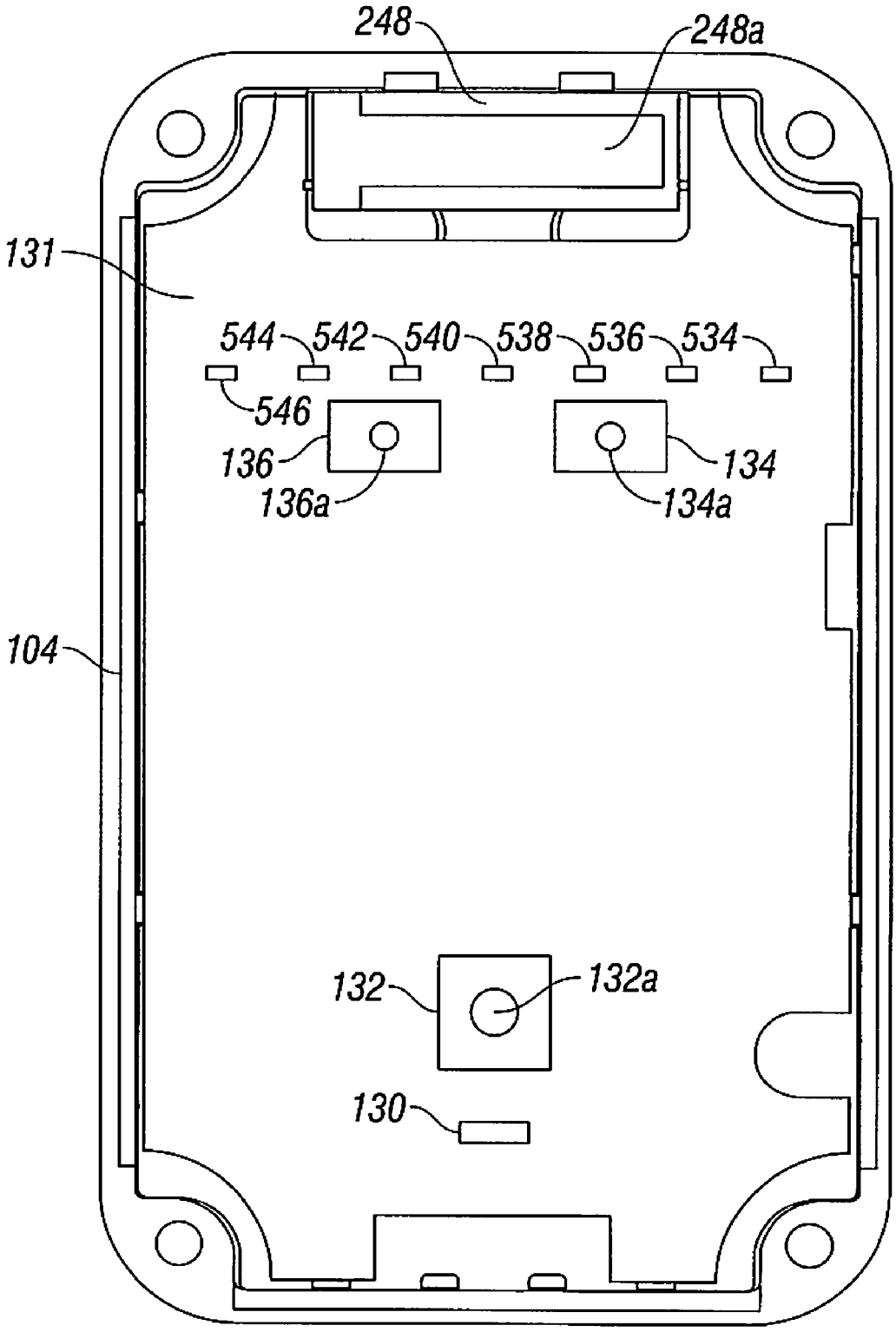
FIG. 5 is a top view showing a circuit board operatively coupled to the actuating assembly and the switching device of the present disclosure.

Referring now to FIGS. 2, 3, and 5, a perspective view of the housing cover 102 is depicted showing the so-called neutral orientation of the rocker switch 108. As shown in FIG. 3, the housing cover 102 includes leaf springs 138, 140 which are movable to electromechanically engage contacts 134*a* and 136*a* disposed in housing 104. The light pipe 111 may be formed as an integral part of the housing cover 102 and illuminates to facilitate user control of the rocker switch 108. As mentioned above, housing cover 102 also includes slots 144, 146 and 148 formed therein which are positioned to engage corresponding interfaces 110A 110B, 110C, respectively, in a snap-fit manner.

With continued reference to FIG. 2, the light pipe 111 extends outwardly from the surface of the housing cover 102 and includes a peg 142A configured and dimensioned to be received within a pivot aperture 108*a* defined through rocker switch 108 to support rocker switch 108 in a pivot-like manner. As shown in FIG. 3, the rocker switch 108 is mounted to move leaf springs 138 and 140 into contact with contacts 134*a* and 136*a* when rotated about peg 142A. Light pipe 111 has legs 111A, 111B, 111C, 111D, 111E, 111F, and 111G which are configured to stabilize the rocker switch 108 during rotation thereof.

FIG. 3 shows the interaction of rocker switch 108 with leaf springs 138 and 140 (shown in phantom representation). Each contact 134*a* and 136*a* is operably connected to a corresponding micro-switch 134 and 136 respectively. The contacts 134*a* and 136*a* may be spring-loaded to enhance tactile feel of the rocker switch 108 through a range of motion. In other words, when rocker switch 108 is depressed to pivot, the leaf spring, e.g., 138, engages contact 136*a* which, in turn, pushes down to activate micro switch 136. Upon release of rocker switch 108, leaf spring 138 recoils back to a neutral or original position allowing contact 136*a* of micro switch 136 to spring back into position. Pivoting rocker switch 108 in the opposite direction, causes a similar effect on micro switch 134.

Light pipe 111, peg 142A, leaf springs 138 and 140, and micro-switches 136 and 134 together form a rocker switch assembly that, when activated, may be used to control the intensity of a light, the relevant speed of a fan, the temperature setting of a thermostat, or any other similar electrical device and/or system connected to the switch of the present disclosure. In embodiments, light pipe 111, peg 142A, leaf springs 138 and 140, and micro-switches 136 and 134 together form a rocker switch assembly that, when activated, may be used to actuate an ON/OFF switch.

Referring now to FIG. 4, a rear perspective view of the paddle actuator 100 shown in FIG. 1 is depicted. Integrally formed on the rear of paddle actuator 100 is a power switch actuator tab 110. It should be understood that the power switch (not explicitly shown) can be implemented with an air-gap switch actuating tab 110C and corresponding air gap switch interface 248 adapted to disconnect a power line from one side of a switch or other device when oriented in an open orientation. It will be readily understood that the power switch can be implemented with other types of switches and is not limited to an air-gap switch. Formed on actuator tab 110 are mechanical interfaces 110A, 110B, and 110C. Also formed on paddle actuator 100 is a switch actuating tab 113A and a paddle locking tab 113. As mentioned above, paddle locking tab 113 includes mechanical interfaces 113C which operatively lock the paddle actuator 100 to housing cover 102.

Referring now to FIG. 5, depicted therein is a printed circuit board 131. Certain elements of printed circuit board 131 are positioned to engage corresponding elements of the paddle actuator 100 of FIG. 1 and housing cover 102 of FIG. 2. That is, when switch 10 is assembled, housing cover 102 is sandwiched between paddle actuator 100 and printed circuit board 131. Paddle actuator 100, housing cover 102, and circuit board 131 are operatively coupled to each other to form a sub assembly within housing 104 to complete the switching device 10 of FIG. 1. As shown in FIG. 5, printed circuit board 131 includes a micro switch 132 having a spring-loaded plunger 132A. In embodiments, the power switch (not explicitly shown) may be implemented with an air-gap switch actuating tab. In embodiments, air-gap switch may be mounted on another printed circuit board (not explicitly shown) located relative to printed circuit board 131 or may be integrally-associated with printed circuit board 131.

An air-gap switch interface 248 extends through a cut out in printed circuit board 131 as shown. Micro-switches 134 and 136 and their corresponding spring-loaded plungers 134A and 136A are also disposed on printed circuit board 131 and positioned to correspond to the placement of leaf springs 138 and 140 (FIG. 2), respectively. LEDs 534, 536, 538, 540, 542, 544 and 546 are positioned to correspond to the locations of the legs 111A-G of light pipe 111 (FIG. 2) such that when housing cover 102 and circuit board 131 are cooperatively assembled, each corresponding LED 534, 536, 538, 540, 542, 544 and 546 is positioned directly beneath a corresponding leg 111A-G of light pipe 111.

In use, when rocker switch 108 is depressed to pivot, any one or more of LEDs 534, 536, 538, 540, 542, 544, and 546 is configured to illuminate to provide a visual status of a load connected to the switching device 10. By way of example, a first depression of rocker switch 108 may illuminate LED 546 and a second depression of rocker switch 108 may illuminate LED 544 and turn off LED 546. Alternatively, the second depression of rocker switch 108 may illuminate LED 544 such that LEDs 546 and 544 are illuminated simultaneously and/or in sequence from left to right. In this scenario, each subsequent depression of rocker switch 108 illuminates the LED to the right (e.g., LED 542, LED 540, etc.) or the LED following the LED illuminated by the previous depression of rocker switch 108 (e.g., a third depression of rocker switch 108 illuminates LED 542). In embodiments, LEDs 534, 536, 538, 540, 542, 544, and 546 may illuminate individually or in sequence from right to left. For example, a first depression of rocker switch 108 may illuminate LED 534 and each subsequent depressions of rocker switch 108 illuminates the LED to the left (e.g., LED 536, LED 538, etc.) or the LED following the LED illuminated by the previous depression of rocker switch 108.

In embodiments, paddle actuator 100 may be configured to cause any one or more of LEDs 534, 536, 538, 540, 542, 544, and 546 to illuminate in the same manner as described above with respect to rocker switch 108 (e.g., individually, sequentially from right to left, sequentially left to right, or any other possible combination, etc.). The seven LED 534, 536, 538, 540, 542, 544, and 546 configuration (FIG. 5) and corresponding seven leg 111A-G configuration (FIG. 2) are illustrative only. That is, the switching device 10 may include any suitable number of LEDs and corresponding legs (e.g., 3, 5, 9, etc.) as would be necessary to effect the switching device 10 operating as intended and in accordance with the present disclosure.

With returned reference to FIG. 2, housing cover 102 has a slot or an opening 148 defined therethrough positioned such that actuator tab 110C of air-gap actuator 110 (FIG. 4) extends to engage air-gap switch interface 248 (FIG. 5) when housing cover 102 is mated with paddle actuator 100 and circuit board 131. If the air-gap switch is not closed by virtue of the paddle actuator 100 being physically incorporated atop housing cover 102, energy will not flow through the switching device electrical elements to operate the switching device 10.

Figure 6:
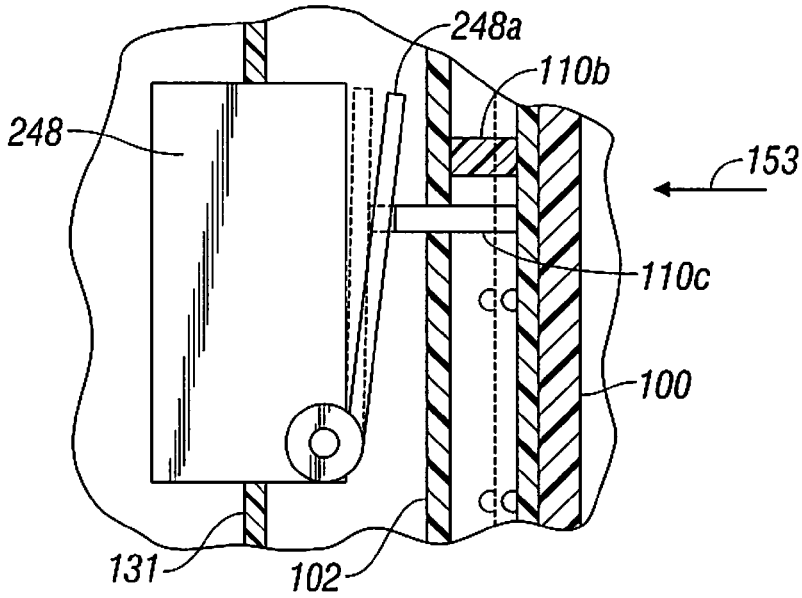
FIG. 6 is a partial cross sectional view showing the relative movement of a power/disengagement switch for use with the switching device of the present disclosure.

FIG. 6 shows the details of the air-gap switch actuating tab 110*c* and interface 248. As depicted, when paddle actuator 100, housing cover 102 and circuit board 131 are cooperatively assembled, pressing paddle actuator 100 in the direction indicated by directional arrow 153 extends air-gap switch actuating tab 110*c* of air-gap actuator 110 through opening 148 in housing cover 102 to engage spring-loaded lever 248A of air-gap switch 248. It should be understood that the operation of air-gap switch 248 can be the reverse of the above description. That is, when the paddle actuator 100 is depressed, air-gap switch 248 connects the power line (not explicitly shown) to the switch 10 and when paddle actuator 100 is pulled outward from the rest position to a pulled out position, the air-gap switch 248 disconnects the power line from the switch 10. Pulling paddle actuator 100 from the rest position to the pulled out position may be accomplished by pulling the bottom portion of paddle actuator 100 in the direction indicated by directional arrow 157 in FIG. 9 to pivot paddle actuator 100 about mechanical interfaces 110B and/or rotate paddle actuator 100 in the clock-wise direction from the rest position. Rotation of paddle actuator 100 in the clock-wise direction from the rest position to the pulled out position may also be achieved by depressing a top portion of paddle actuator 100 by applying sufficient force thereto. Optionally, a detent (not shown) may be provided such that when paddle actuator 100 is pulled and the air-gap switch 248 disconnects power to the switch 10, the paddle actuator 100 will remain in a pulled out position.

Figure 7:
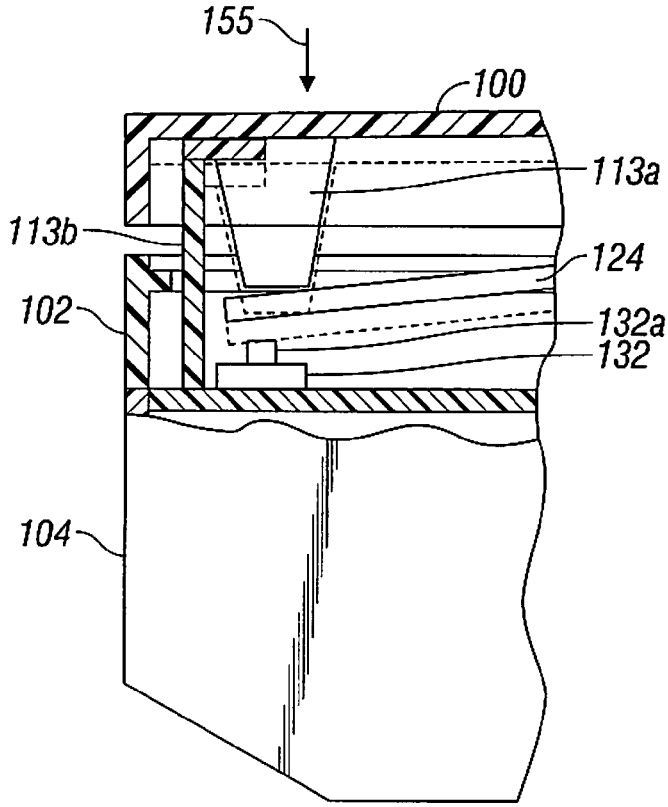
FIG. 7 is a partial cross sectional view showing the relative movement of a micro-switch in accordance with the present disclosure.

When paddle actuator 100, housing cover 102 and circuit board 131 are cooperatively assembled, paddle actuator 100 pivots along mechanical interfaces 110A, 110B which are snap-fit into wells 144 and 146, respectively. Located directly beneath the point of resilient contact between tab 113A and leaf spring 124 is micro-switch 132 and spring-loaded plunger 132A. This arrangement, depicted in FIG. 7, brings actuating tab 113A into resilient contact with a leaf spring 124 formed in housing cover 102 (see FIGS. 2, 4, and 7) to actuate the spring-loaded plunger 132A disposed in housing 104 which activates micro-switch 132 to connect the switching device 10 to line phase or electrical power or interrupt connection of the switching device 10 to line phase or electrical power. This action changes the state of a load connected to switch 10 from OFF to ON or vice-versa. In embodiments, this action may be configured to change the state of a load connected to switch 10 from DIM to BRIGHT and/or any one or more levels therebetween (e.g., greater than DIM and less than BRIGHT).

Figure 9:
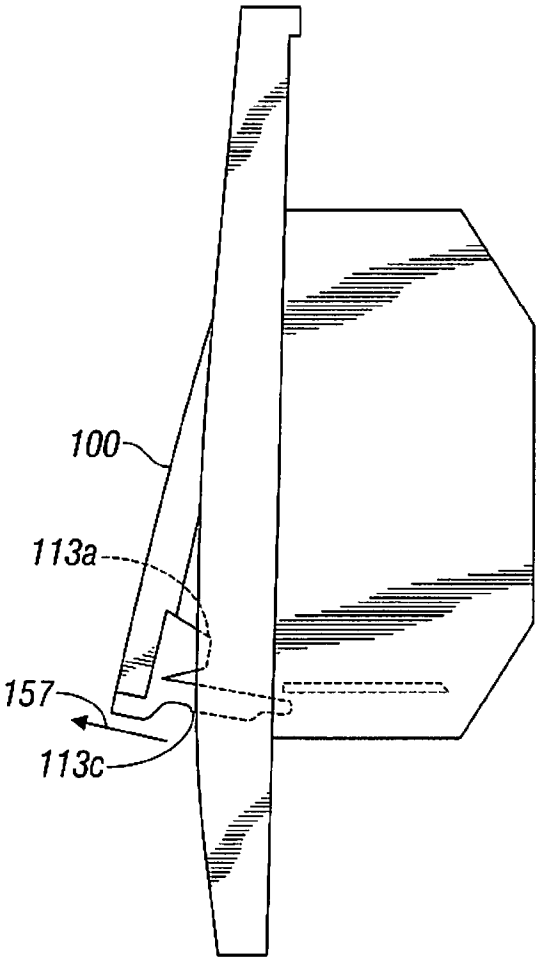
FIGS. 8 and 9 are side views showing the relative movement of the power switch relative to the housing.
Figure 8:
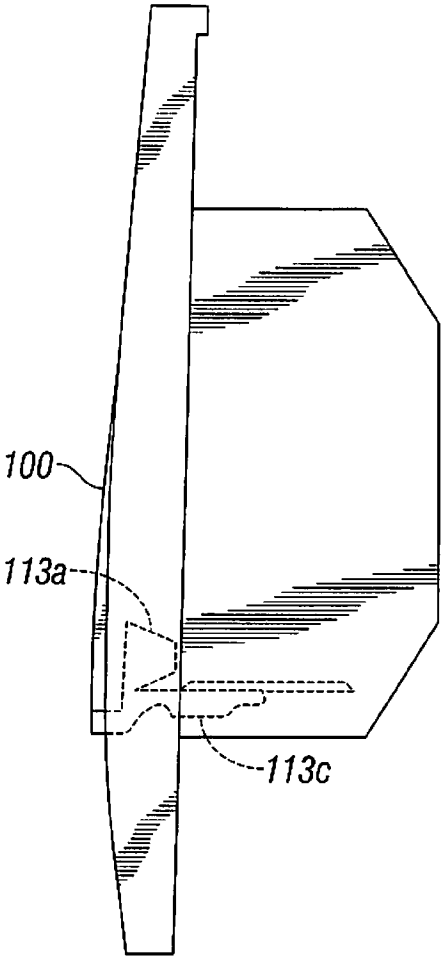

The sloping ramp configuration of locking surface 113C shown in FIGS. 8 and 9 permits retraction of tab 113 and locking surface 113C from opening 125 (FIG. 2) when sufficient force is applied to a bottom portion of paddle actuator 100, as shown in FIG. 9.

Still referring to FIG. 9, when the bottom portion of paddle actuator 100 is pulled in the direction indicated by directional arrow 157, surface 113C disengages from tab 124 and permits paddle actuator 100 to pivot about mechanical interfaces 110B and/or rotate in the clock-wise direction.

Figure 10:
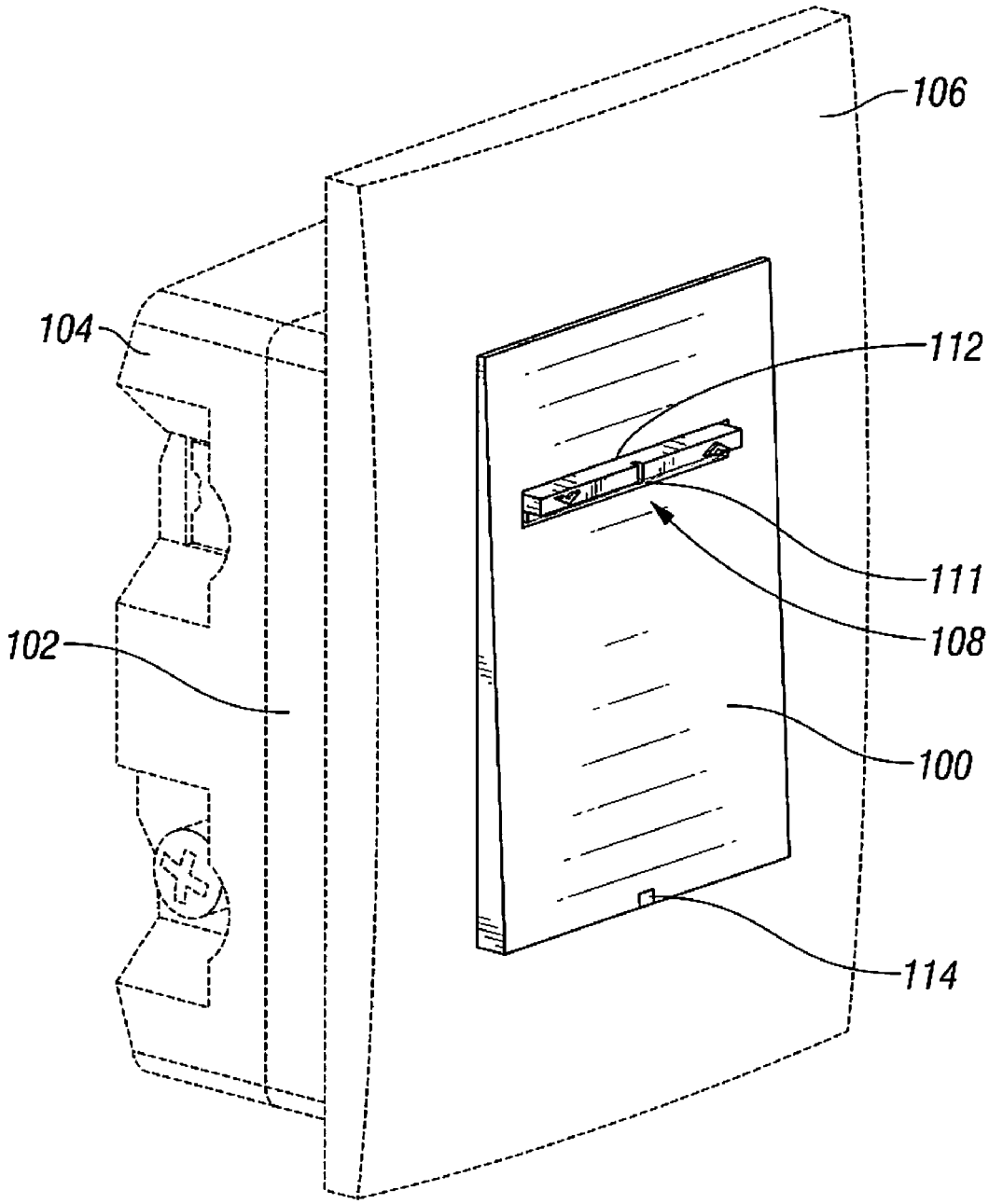
FIGS. 10 and 11 are perspective views of a switching device in accordance with embodiments of the present disclosure.

Referring now to FIG. 10, another embodiment of the present disclosure is shown depicting another dimmer switch. This dimmer switch includes a housing 104, a housing cover 102, and a paddle actuator 100. The paddle actuator 100 includes an opening 112 defined therethrough which is dimensioned to receive a light pipe 111 and a rocker switch 108 therein. In the illustrated embodiment, light pipe 111 is disposed below rocker switch 108.

Figure 11:
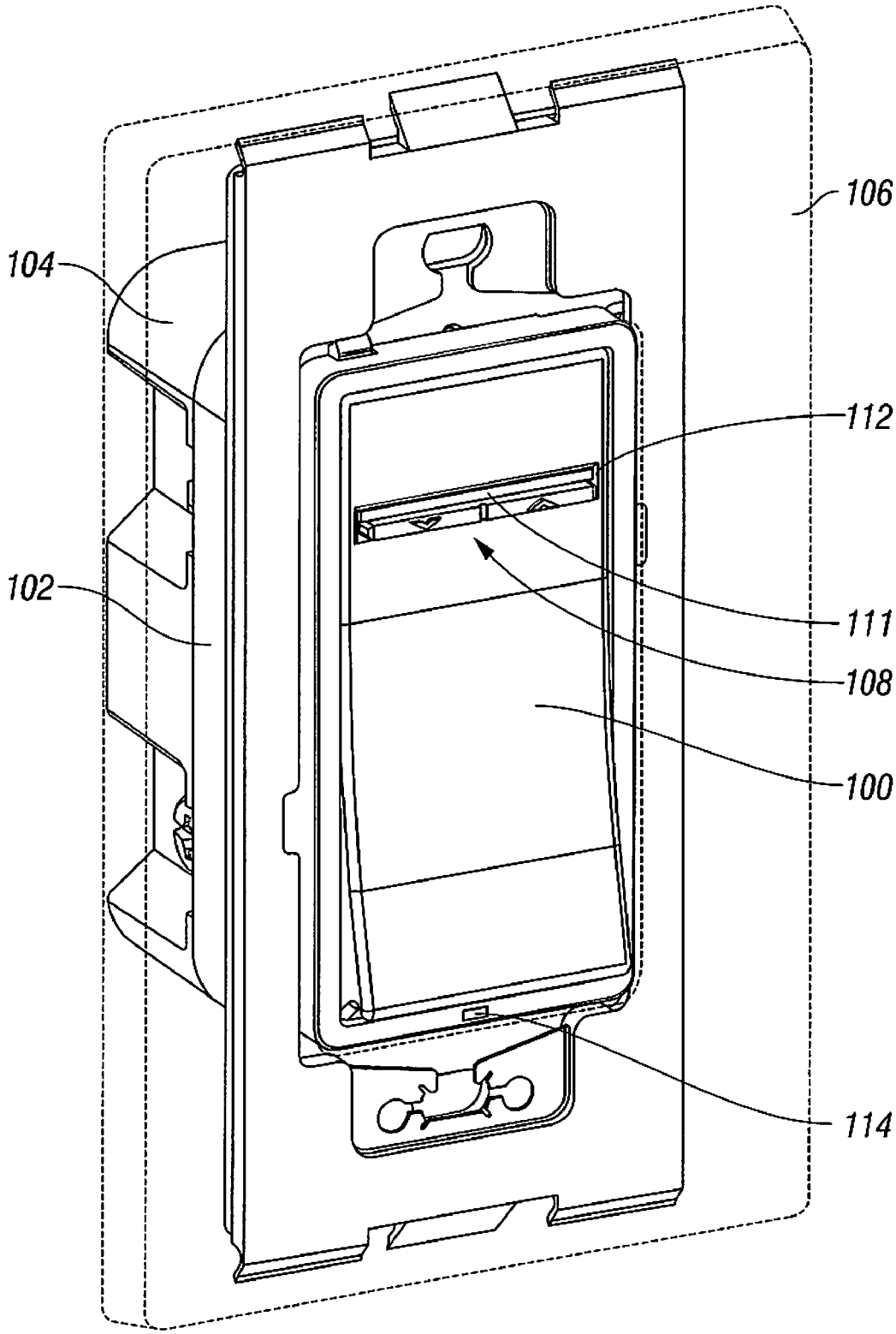
Figure 12:
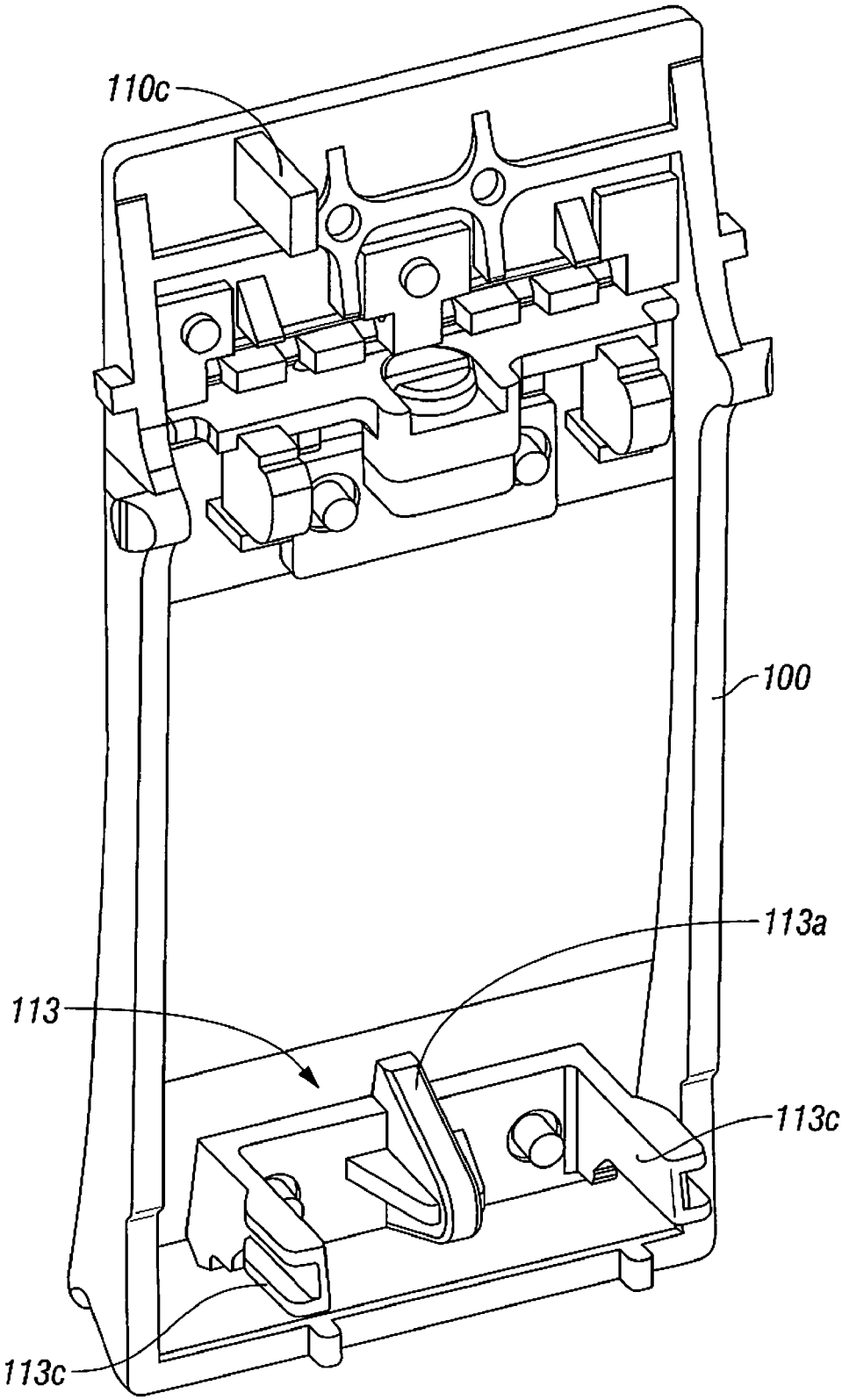
FIG. 12 is a perspective view of an actuator operatively associated with the switching device of FIG. 11.

Referring now to FIG. 11, another embodiment of the present disclosure is shown depicting another dimmer switch This dimmer switch includes a housing 104, a housing cover 102, and a paddle actuator 100. The paddle actuator 100 includes an opening 112 defined therethrough which is dimensioned to receive a light pipe 111 and a rocker switch 108 therein. A rear perspective view of the paddle actuator 100 shown in FIG. 11 is depicted in FIG. 12.

Figure 13:
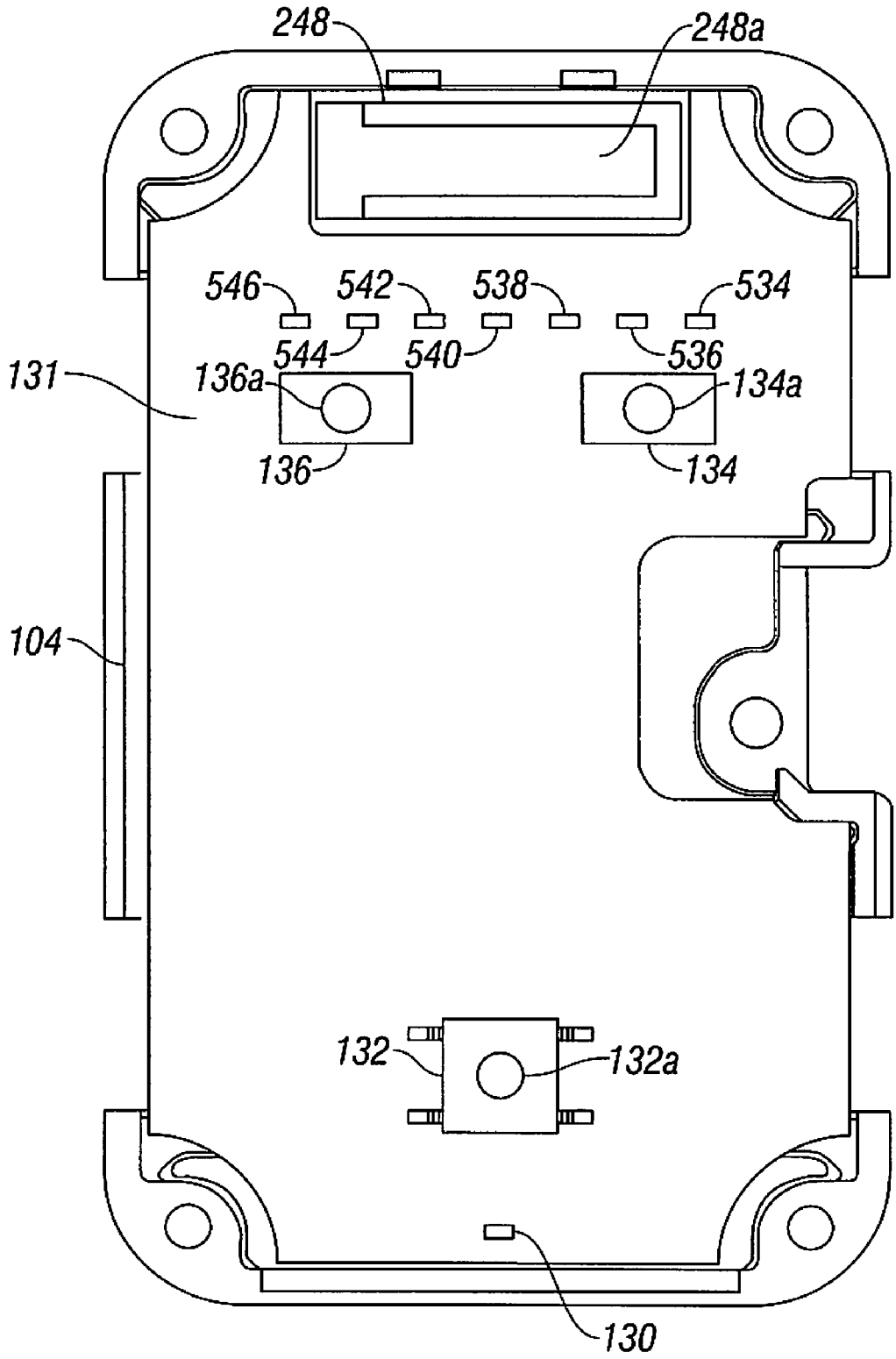
FIG. 13 is a top view showing a circuit board operatively coupled to the switching device of FIG. 11.

Referring now to FIG. 13, depicted therein is a printed a circuit board 131 having certain elements positioned to engage corresponding elements of the paddle actuator 100 and housing cover 102 of FIG. 11.

While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A switching device, comprising:

a paddle actuator biased to a rest position and configured to pivot relative to a housing to a depressed position to engage an air-gap switch disposed within the housing, the air-gap switch configured to change a first state of a load connected to the switching device upon engagement by the paddle actuator, the paddle actuator defined by a pair of opposing long sides and a pair of opposing short sides and having at least one slot defined therein parallel to the pair of opposing short sides thereof and centrally disposed between the pair of opposing long sides thereof; and a rocker actuator disposed in the at least one slot and configured to pivot relative thereto to engage at least one switch, the at least one switch configured to change a second state of the load connected to the switching device upon engagement by the at least one rocker actuator.

2. A switching device according to claim 1, wherein at least one of the first state and the second state of the load is one of a connection of the switching device to a line phase and an interruption of the connection of the switching device to the line phase.

3. A switching device according to claim 1, wherein at least one of the first state and the second state of the load is an intensity of power of a line phase connected to the switching device during at least one of the other states of the load.

4. A switching device according to claim 1, further comprising a light pipe operably coupled to the rocker actuator and having at least one LED configured to indicate at least one of the first state and the second state of the load upon actuation of at least one of the paddle actuator and the rocker actuator.

5. A switching device according to claim 4, wherein the light pipe includes a plurality of sequentially disposed LEDs configured to illuminate to indicate at least one of the first state and the second state of the load upon actuation of at least one of the paddle actuator and the rocker actuator.

6. A switching device according to claim 5, wherein the plurality of sequentially disposed LEDs are configured to sequentially illuminate to indicate at least one of the first state and the second state of the load upon actuation of at least one of the paddle actuator and the rocker actuator.

7. A switching device according to claim 5, wherein one of the plurality of sequentially disposed LEDs are configured to illuminate to indicate at least one of the first state and the second state of the load upon actuation of at least one of the paddle actuator and the rocker actuator.

8. A switching device according to claim 1, further comprising a light pipe disposed on the paddle actuator and having at least one LED configured to indicate at least one of the first state and the second state of the load upon actuation of at least one of the paddle actuator and the rocker actuator.

9. A switching device according to claim 1, further comprising at least one LED disposed on the paddle actuator and configured to provide a visual status of the switching device.

10. A switching device according to claim 1, wherein at least one of the first state and the second state of the load is a fan speed.

11. A switching device according to claim 1, wherein at least one of the first state and the second state of the load is a thermostat setting.

12. A switching device according to claim 1, wherein the air-gap switch is configured to rotate clock-wise from the rest position upon one of pulling a bottom portion of the paddle actuator and depressing a top portion of the paddle actuator to change a first state of a load connected to the switching device.

13. A switching device, comprising:

a paddle actuator biased to a rest position and configured to pivot relative to a housing to a depressed position to engage an air-gap switch disposed within the housing, the air-gap switch configured to change a first state of a load connected to the switching device upon engagement by the paddle actuator, the paddle actuator defined by a pair of opposing long sides and a pair of opposing short sides and having at least one slot defined therein parallel to the pair of opposing short sides thereof and centrally disposed between the pair of opposing long sides thereof;

a rocker actuator disposed in the at least one slot and configured to pivot relative thereto to engage at least one switch, the at least one switch configured to change a second state of the load connected to the switching device upon engagement by the at least one rocker actuator; and a light pipe operably coupled to the rocker actuator and having a plurality of LEDs disposed thereon configured to indicate at least one of the first state and the second state of the load connected to the switching device upon actuation of at least one of the paddle actuator and the rocker actuator.

14. A switching device according to claim 13, wherein at least one of the first state and the second state of the load is one of an ON and OFF state.

15. A switching device according to claim 13, wherein at least one of the first state and the second state of the load is one of a DIM and BRIGHT state.

16. A switching device according to claim 13, wherein the first state of the load is one of an ON and OFF state and the second state of the load is varied between a DIM and BRIGHT state.

17. A switching device according to claim 13, wherein the first state of the load is varied between a DIM and BRIGHT state and the second state of the load is one of an ON and OFF state.

18. A switching device according to claim 13, wherein at least one of the first state and the second state of the load is one of a connection of the switching device to a line phase and an interruption of the connection of the switching device to the line phase.

19. A switching device according to claim 13, wherein at least one of the first state and the second state of the load is an intensity of power of a line phase connected to the switching device during at least one of the other states of the load.

* * * * *